US006773100B2

(12) United States Patent
Kulpa et al.

(10) Patent No.: US 6,773,100 B2
(45) Date of Patent: Aug. 10, 2004

(54) INSERTION/EXTRACTION MECHANISM FOR AN INK CARTRIDGE

(75) Inventors: Walter J. Kulpa, Trumbull, CT (US); Edward O'Sullivan, Meriden, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/326,509

(22) Filed: Dec. 19, 2002

(65) Prior Publication Data

US 2004/0119799 A1 Jun. 24, 2004

(51) Int. Cl.[7] ..... B41J 2/175
(52) U.S. Cl. ..... 347/86; 347/85
(58) Field of Search ..... 347/49, 86, 87, 347/214, 108; 399/110, 111, 262, 207, 208; 220/676, 677; 222/325, 83

(56) References Cited

U.S. PATENT DOCUMENTS 5,250,957 A 10/1993 Onozato
5,427,023 A 6/1995 Privin
5,798,777 A * 8/1998 Yoshimura et al. ..... 347/44
5,805,181 A 9/1998 Tanaka et al.
5,933,173 A 8/1999 Solero
6,250,750 B1 * 6/2001 Miyazawa et al. ..... 347/87
6,280,025 B1 8/2001 Beckstrom et al.
6,431,697 B1 * 8/2002 King et al. ..... 347/86

* cited by examiner

*Primary Examiner*—Anh T. N. Vo
(74) *Attorney, Agent, or Firm*—Brian A. Lemm; Angelo N. Chaclas

(57) ABSTRACT

A receiving assembly for an ink cartridge is provided. A replaceable ink cartridge is provided with one or more bosses that extend out from the ink cartridge. A lever is rotatively mounted to a housing for the ink cartridge. The lever includes a curved cam slot. During rotational movement of the lever, the cam slot operatively engages a respective boss and causes the boss to follow a cam formed by the sides of the cam slot. Following the cam form by the cam slot cause the boss to move either upward or downward, according to the direction of the rotational movement, and corresponding movement of the ink cartridge. Downward movement of the ink cartridge will cause a needle mounted to the housing to puncture a septum in the bottom of the ink cartridge, thereby allowing access to the ink contained therein.

8 Claims, 4 Drawing Sheets

INSERTION/EXTRACTION MECHANISM FOR AN INK CARTRIDGE

FIELD OF THE INVENTION

This invention relates generally to the field of ink jet printing, and more particularly to a receiving assembly for inserting and removing a disposable ink cartridge.

BACKGROUND OF THE INVENTION

Ink jet printing mechanisms are well known and have been adapted to a variety of applications and devices, including, for example, office printers, point of sale devices, and mailing machines. Generally, ink jet printing mechanisms include a print head that ejects a series of ink drops onto paper or other medium, until a desired image is achieved. A reservoir of ink keeps the print head supplied with ink.

Typically, a mailing machine utilizes an ink jet printing mechanism in conjunction with a postage metering system included in the mailing machine. Postage metering systems store and dispense postage. Print quality, therefore, becomes more significant in that the ink jet printer must operate reliably to prevent the operator from experiencing loss of postal funds (money) due to a postage indicia being unreadable. Therefore, proper delivery of ink from the ink cartridge to the print head has increased importance. Delivery of the ink can be facilitated by proper installation of an ink cartridge.

In many applications it is desirable to have a user replaceable ink cartridge for providing the reservoir of ink. In this manner, when one supply of ink has been exhausted, an empty ink cartridge may be replaced with a new ink cartridge to replenish the ink supply.

An ink cartridge should be easily inserted into and removed from the ink jet printing mechanism. Preferably, even an inexperienced operator should find the process intuitive and the process should require minimal physical effort. Due to the location of an ink cartridge within a mailing machine, insertion and extraction of an ink cartridge can sometimes be difficult for some operators.

Ink cartridges typically include a septum that is pierced with a needle to access a supply of ink within the cartridge. For safety reasons, a blunt needle is utilized to pierce the septum of the ink cartridge. The use of a blunt needle can result in a higher than desirable force to perform the piercing operation. In addition, incorporation of an ink jet printing mechanism within a mailing machine may limit access to the location of insertion, thereby adding to the difficulty of supplying the force required to puncture the septum with the blunt needles. Extraction of an empty ink cartridge may also be difficult if the location of the ink cartridge limits access to it.

Therefore, there is a need for an assembly to receive an ink jet cartridge that is intuitive to a user regarding insertion and extraction of the ink cartridge, and that is easy to utilize and does not require an inordinate amount of physical force.

SUMMARY OF THE INVENTION

The present invention alleviates the problems associated with the prior art and provides a receiving assembly for an ink cartridge that is easy to use and does not require an inordinate amount of physical force to insert or extract an ink cartridge.

In accordance with the present invention, a replaceable ink cartridge is provided with one or more bosses that extend out from the ink cartridge. A lever is rotatively mounted to a housing for the ink cartridge. The lever includes a curved cam slot. During rotational movement of the lever, the cam slot operatively engages a respective boss and causes the boss to follow a cam formed by the sides of the cam slot. Following the cam form by the cam slot causes the boss to move either upward or downward, according to the direction of the rotational movement, and corresponding movement of the ink cartridge. Downward movement of the ink cartridge will cause a needle mounted to the housing to puncture a septum in the bottom of the ink cartridge, thereby allowing access to the ink contained therein. The mechanical advantage provided by the lever assembly of the present invention facilitates removal or insertion of an ink cartridge and significantly reduces the amount of force required by an operator to insert or remove the ink cartridge.

Therefore it should now be apparent that the invention substantially achieves all the above aspects and advantages. Additional aspects and advantages of the invention will set forth in the description that follows, and in part will be obvious from the description, or may be learned by practice of the invention. Various features and embodiments are further described in the following figures, descriptions and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

The present invention includes apparatus and methods for inserting and removing an ink cartridge from an ink jet printing mechanism, such as, for example, those utilized in conjunction with a mailing machine. According to the present invention, a housing is adapted to receive an ink cartridge and an insertion mechanism rotatively mounted to the housing is utilized to facilitate insertion of the ink cartridge into the housing, including puncturing of one or more septum with a blunt needle during the insertion. The insertion mechanism can also be utilized to facilitate removal of the ink cartridge from the pocket.

Figure 1A:
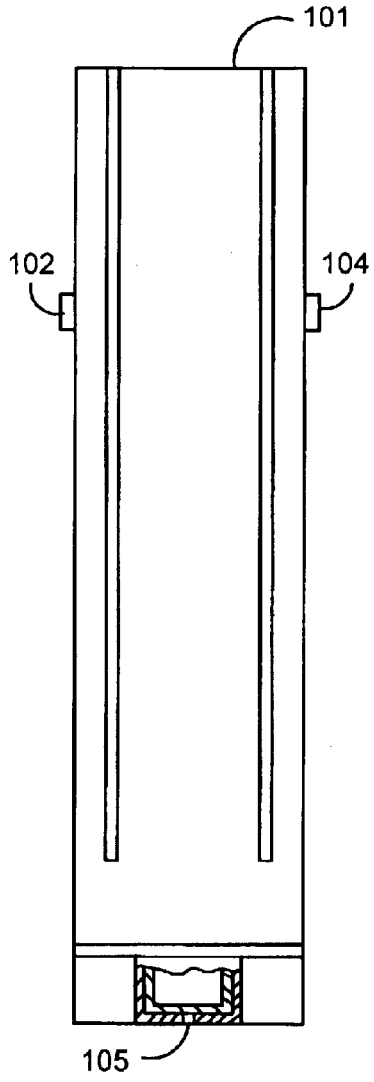
FIGS. 1A and 1B illustrate a frontal view and a profile view, respectively, of an ink cartridge according to the present invention.
Figure 1B:
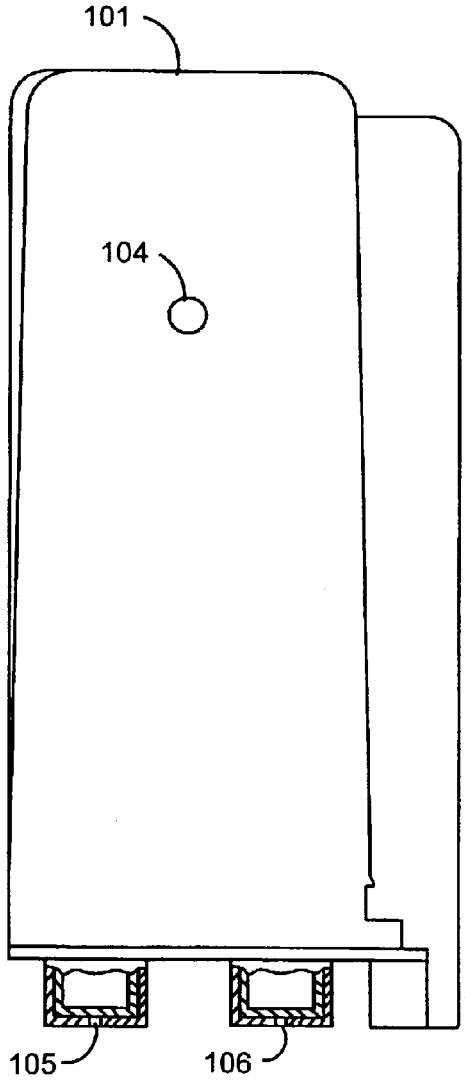
Figure 2:
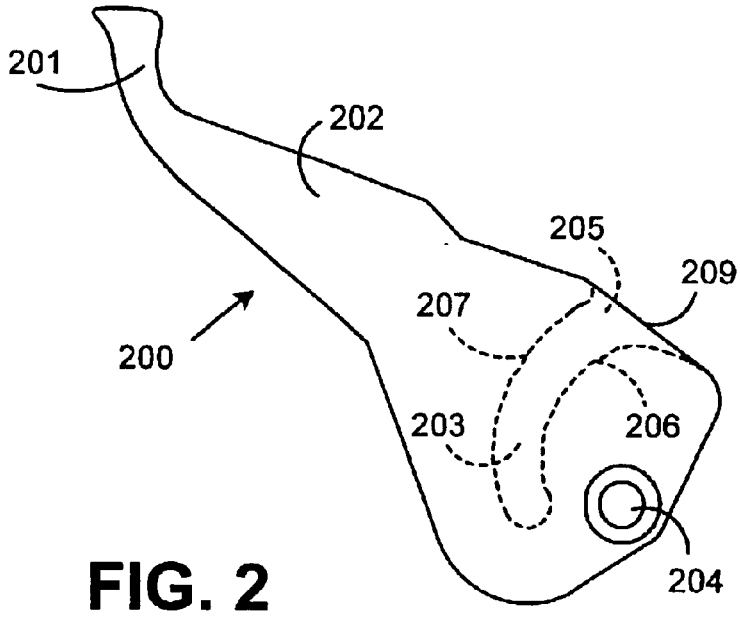
FIG. 2 illustrates a side view of a lever utilized to insert and extract an ink cartridge according to the present invention.

Referring now to FIGS. 1A, 1B and 2, an ink cartridge 101 and a lever 200 according to the present invention are illustrated. The ink cartridge 101 has one or more bosses 102, 104 or other latching device that can be engaged by the lever 200. A frontal view (FIG. 1A) shows the bosses 102, 104 extending out from the sides of the ink cartridge 101. A side view (FIG. 1B) shows a boss 104 of a generally circular shape.

An ink cartridge 101 can also include one or more septum 105, 106 or other device for sealing a supply of ink contained within the ink cartridge 101. In order to access the ink contained within the ink cartridge 101, the septum 105, 106 can be punctured with a needle.

Figure 5:
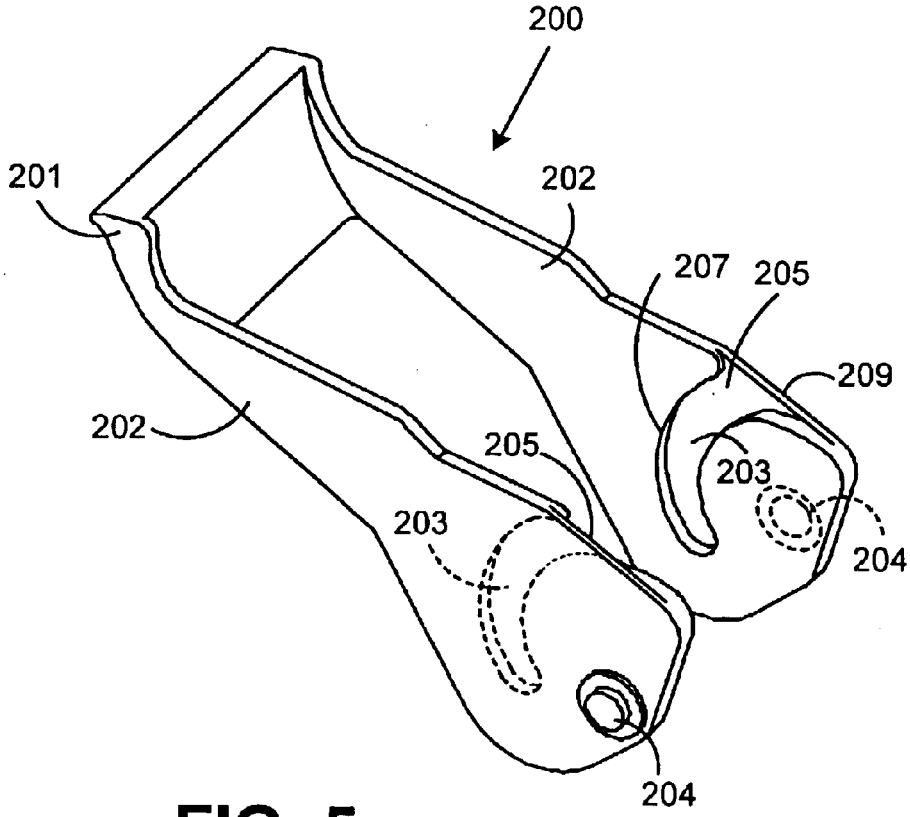
FIG. 5 illustrates a perspective view of the lever of FIG. 2.

The lever 200 can be utilized to operatively engage the boss 102, 104 formed into each side of the ink cartridge 101 or otherwise attached to the ink cartridge 101. The boss 102, 104 can be engaged with a curved cam slot 203 in each side of the lever 200 or some other engaging mechanism. Preferably, as illustrated in FIG. 5, the cam slots 203 do not pass completely through the lever 200, but are provided with a wall 209 on the outside that strengthens the lever 200 by spanning the slots 203 along their full length. The curved cam slots 203 can include an open end 205 for receiving, or otherwise engaging a respective boss 102, 104. The lever 200 can also include a pivotal mount 204 on each side. The pivotal mounts 204 can be utilized to mount the lever 200 and allow rotational movement in the lever 200 about the pivotal mounts 204. The lever 200 can include a handle portion 201 which can be grasped by an operator to supply rotational movement to the lever 200 during insertion or removal of an ink cartridge. The handle portion 201 can be connected to a body portion 202 on each side. Each body portion 202 includes a cam slot 203 and a pivot 204.

During rotational movement of the lever 200 around the pivots 204, the cam slots 203 can operatively engage a respective boss 102, 104 and cause the respective boss 102, 104 to follow a cam formed by the sides of the cam slots 203. The shape of the cam formed by the cam slots 203 can control movement of the respective boss 102, 104 and an ink cartridge 101 to which the bosses 102, 104 are attached. The lower surface 206 of the cam slots 203 can be adapted to support the respective boss 102, 104 located on the ink cartridge 101 when the lever is in a non-inserted position.

Figure 3:
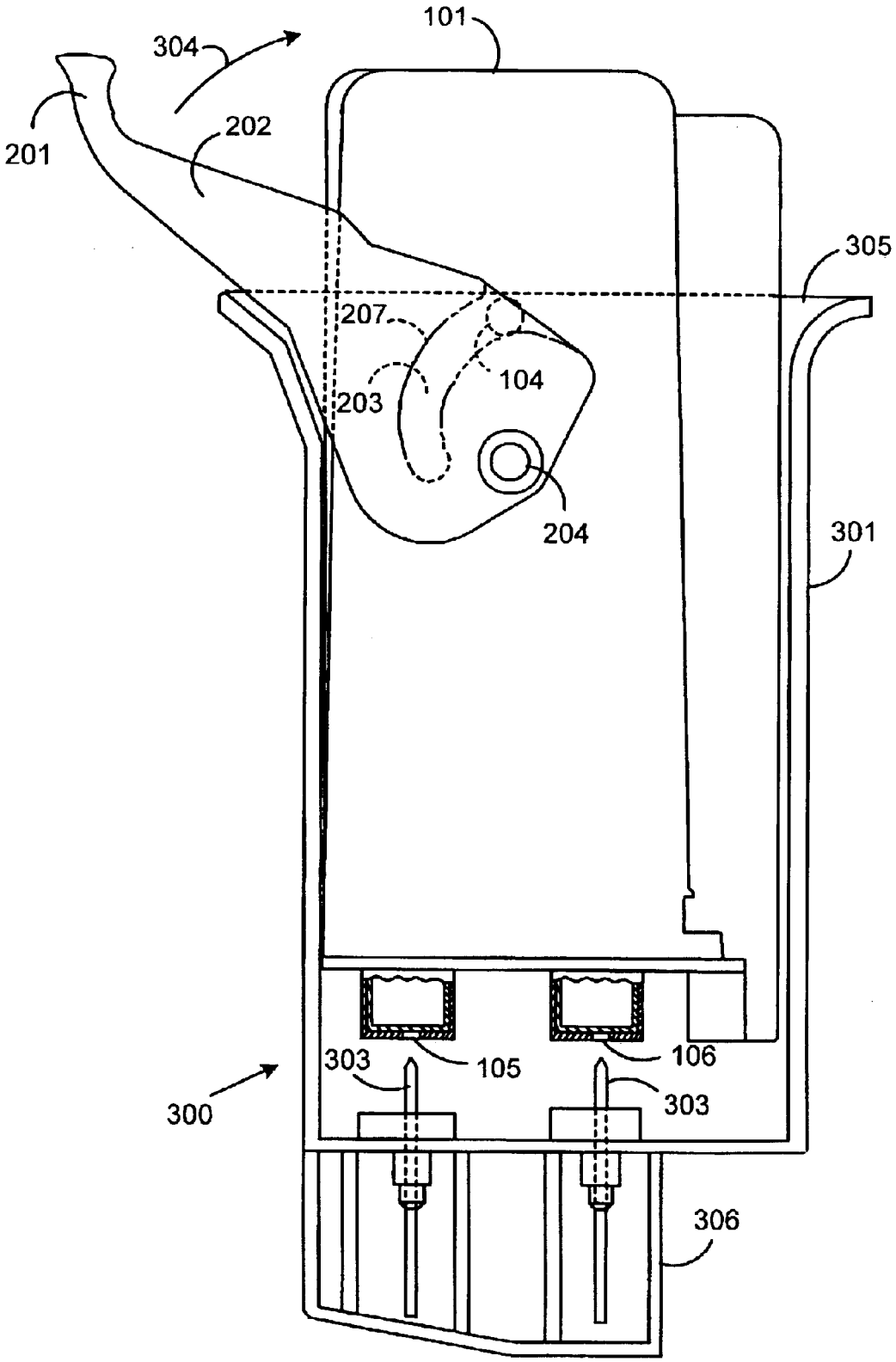
FIG. 3 illustrates an ink cartridge being inserted into a receiving assembly utilizing the lever of FIG. 2 in accordance with the present invention.

Referring now to FIG. 3, a receiving assembly 300 is illustrated which can receive an ink cartridge 101. The receiving assembly 300 can include a housing 301 with an open end 305 and a closed end 306. The open end 305 and closed end 306 can define a pocket for receiving an ink cartridge 101. The receiving assembly 300 can also include one or more needles 303 mounted to the closed end of the housing 306 and positioned to pierce corresponding septum 105, 106 that seal ink within the ink cartridge 101. The septum 105–106 can be pierced as the ink cartridge 101 is move downward from a non-inserted position to an inserted position.

In order to move the cartridge 101 from the non-inserted position to the inserted position, the lever 200 can be rotatively moved about the pivot mounts 204 in a direction indicated by arrow 304 for causing downward movement of the ink cartridge 101. As the lever 200 is rotatively moved, the cam slots 203 in each body portion 202 can operatively engage a respective boss 102, 104 which is formed into, or attached to, the ink cartridge 101. A mechanical advantage is provided by the location of the cam slots 203 within the lever 200 and the arc of the cam surface forming the cam slots 203. The mechanical advantage can facilitate insertion or removal of an ink cartridge 101. In some embodiments, the combination of the location of the cam slots 203 relative to the handle 201 and the arc of the cam slots 203 can reduce the amount of force required to insert an ink cartridge 101, including piercing the septum 105, 106, to one pound or less of force.

Engagement of the bosses 102, 104 in the cam slots 203 causes the bosses 102, 104 to follow a cam formed by a curved of the earn slots 203. Following the cam formed by the cam slots 203 causes the bosses 102, 104 to move either upward or downward according to the direction of the rotational movement, and hence movement of the ink cartridge 101 either upward or downward according to the direction of the rotational movement. Downward movement of the ink cartridge 101 can cause the needles 303 to contact and eventually pierce the septum 105, 106. A bottom surface 206 of the cam slots 203 can engage the bosses 102, 104 when the lever 200 is in a non-inserted position. The curve of each cam slot 203 can be operative through rotation of the lever 200 to cause an upper surface 207 of the cam slots 203 to engage the boss 102, 104 and push the ink cartridge 101 down onto the needles 303.

Figure 4:
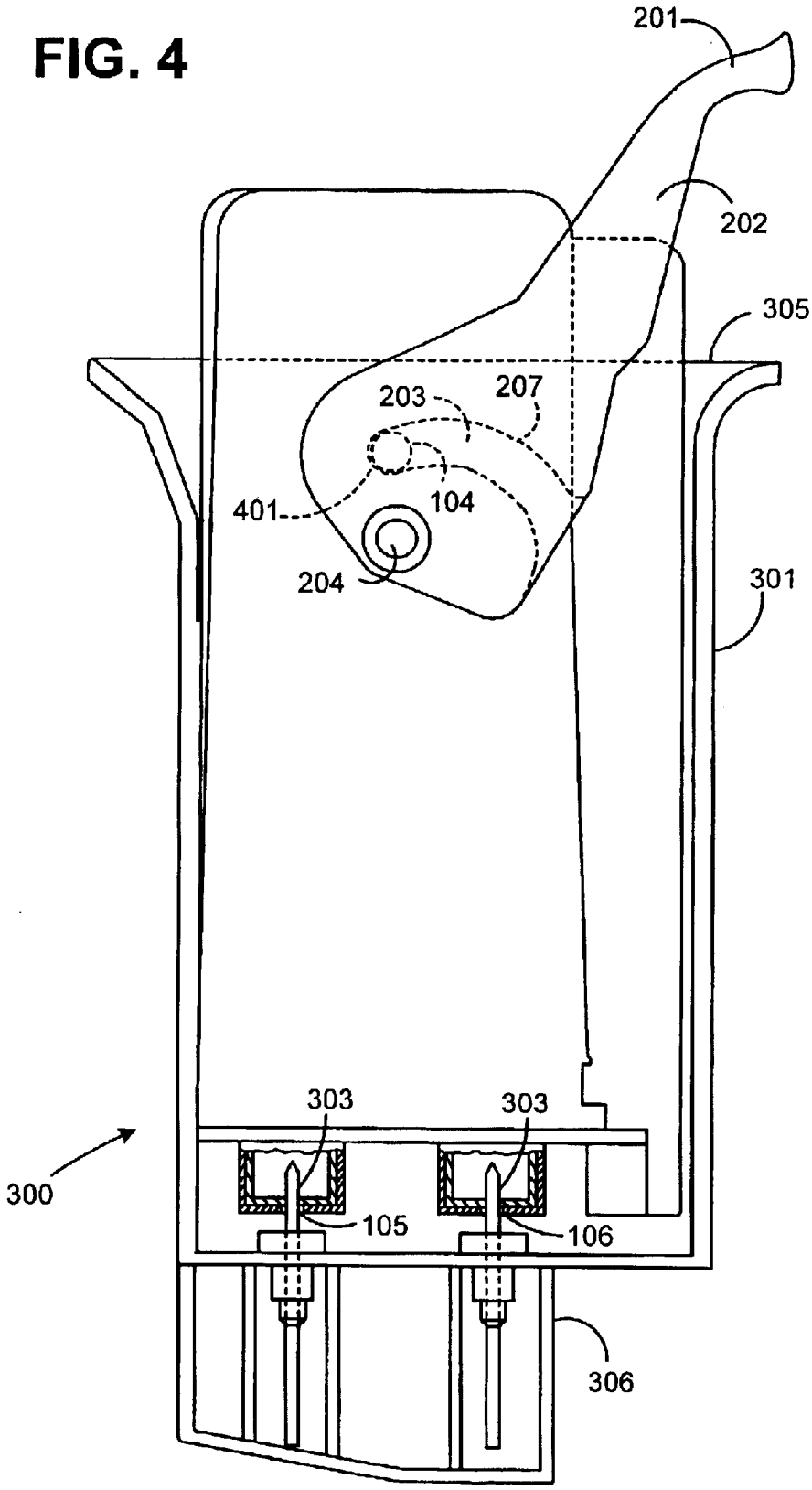
FIG. 4 illustrates an ink cartridge fully inserted into the receiving assembly with the lever of FIG. 2 in accordance with the present invention.

Referring now to FIG. 4, the receiving assembly 300 is shown with the lever 200 rotated around the mounts 204 into an inserted position. The ink cartridge 101 is moved downward into the housing 301 until the needles 303 have pierced the septum 105, 106 allowing the needles 105, 106 to access the ink contained within the ink cartridge 101. The bosses 102, 104 can be positioned at an end point 401 of the cam slots 203 and locked into the inserted position while the lever 200 is maintained in the inserted position.

Referring now to FIG. 5, a perspective view of a lever 200 according to an embodiment of the present invention is illustrated. The perspective view shows an example of a lever 200 with a handle 201 connected to a pair of body portions 202 each having curved cam slots 203 and rotational mounts 204 formed next to each slot 203. The cam slots 203 can each include an open end 205 for engaging a respective boss formed into opposite sides of the ink cartridge 101. The cam slots 203 can engage respective bosses 102, 104 when the lever 200 is in a non-inserted position. The curve of each cam slot 203 can be operative through rotation of the lever 200 to cause an upper surface 207 of each cam slot 203 to engage the boss 102, 104 and push the ink cartridge 101 down onto the needles 303. Optionally, the end of each cam slot 203 will have a straight portion that will be substantially horizontal with respect to the bosses 102, 104 when the lever 200 is in the inserted position, thus ensuring a locking action of the lever 200 and preventing the ink cartridge 101 from back-driving the lever 200 out of the inserted position. When the exemplary lever 200 is installed on a housing 301, the ink cartridge 101 can fit between the body portions such that the bosses 102, 104 will engage the slots 203.

A number of embodiments of the present invention have been described. Nevertheless, it will be understood that various modifications may be made without departing from the spirit and scope of the invention. For example, various mechanical means for engaging an ink cartridge with a lever can be utilized. Components of the present invention can be formed from plastic, steel, aluminum, alloy or other material. In addition, the cartridge can be made to incorporate a lever mechanism into one unit such that each time the cartridge is replaced the lever is also replaced as a unit. Other variations relating to implementation of the functions described herein can also be implemented. Accordingly, other embodiments are within the scope of the following claims.

What is claimed is:

1. A receiving assembly for receiving an ink cartridge having one or more septum sealing ink within an ink holding chamber, the receiving assembly comprising:

a housing defining a pocket for receiving the ink jet cartridge, the pocket having an open end and a closed end;

one or more needles corresponding with each septum mounted to the closed end of the housing and protruding into the pocket; and an insertion mechanism rotatively mounted to the housing to operatively engage the ink bet cartridge for repositioning the ink let cartridge between a non-inserted position and an inserted position, the insertion mechanism including a lever having a pair of curved cam slots, each cam slot having an open end for engaging a respective boss formed into opposite sides of the ink cartridge when the lever is in the non-inserted position, the curves of the cam slots being operative through rotation of the lever to cause an upper surface of each cam slot to engage the respective boss and push the ink cartridge down into the pocket, wherein the non-inserted position causes at least one of the one or more needles to be removed from a corresponding septum and the inserted position causes at least one of the one or more needles to pierce a corresponding septum.

2. The receiving assembly of claim 1, wherein a lower surface of each cam slot is adapted to support a respective boss located on the ink cartridge when the lever is in the non-inserted position.

3. The receiving assembly of claim 1, wherein an end of each cam slot opposite the open end has a straight portion that is substantially horizontal with respect to the respective bosses when the lever is in the inserted position.

4. A housing for a replaceable ink cartridge, the housing comprising:

an open end for receiving the replaceable ink cartridge;

a closed end opposite the open end, the closed end including at least one needle extending into the housing;

a lever rotatably mounted to the housing and movable between a first position and a second position, the lever having a pair of curved cam slots, each cam slot having an open end for engaging a respective boss on opposite sides of the ink cartridge when the lever is in the first position, the curves of the cam slots being operative through rotation of the lever into the second position to cause an upper surface of each cam slot to engage the respective boss and push the ink cartridge down into the housing towards the closed end such that the at least one needle pierces a corresponding septum of the ink cartridge.

5. A mailing machine comprising:

a receiving assembly for receiving an ink cartridge having one or more septum sealing ink within an ink holding chamber, the receiving assembly comprising:

a housing defining a pocket for receiving the ink jet cartridge, the pocket having an open end and a closed end;

one or more needles corresponding with each septum mounted to the closed end of the housing and protruding into the pocket; and an insertion mechanism rotatively mounted to the housing to operatively engage the ink jet cartridge for repositioning the ink jet cartridge between a non-inserted position and an inserted position, the insertion mechanism including a lever having a pair of curved cam slots, each cam slot having an open end for engaging a respective boss formed into opposite sides of the ink cartridge when the lever is in the non-inserted position, the curves of the cam slots being operative through rotation of the lever to cause an upper surface of each cam slot to engage the respective boss and push the ink cartridge down into the pocket, wherein the non-inserted position causes at least one of the one or more needles to be removed from a corresponding septum and the inserted position causes at least one of the one or more needles to pierce a corresponding septum.

6. The mailing machine of claim 5, wherein a lower surface of each cam slot is adapted to support a respective boss located on the ink cartridge when the lever is in the non-inserted position.

7. The mailing machine of claim 5, wherein an end of each cam slot opposite the open end has a straight portion that is substantially horizontal with respect to the respective bosses when the lever is in the inserted position.

8. A method for inserting an ink cartridge with one or more septum into a housing, the method composing:

locating a lever in a non-inserted position;

inserting an ink cartridge into the housing;

engaging the ink cartridge with the lever via at least one boss extending from the ink cartridge; and rotating the lever into an inserted position, wherein the rotation of the lever causes the ink cartridge to move into the housing and on to one or more needles, each needle corresponding with a septum and mounted to a closed end of the housing.

* * * * *